US005758732A

United States Patent [19]

Liw

[11] Patent Number: 5,758,732

[45] Date of Patent: Jun. 2, 1998

[54] CONTROL DEVICE FOR DRILLING A BORE HOLE

[76] Inventor: Lars Liw, Svenstastugan, G:a Pershyttan, S-173 91 Nora, Sweden

[21] Appl. No.: 666,383

[22] PCT Filed: Nov. 22, 1994

[86] PCT No.: PCT/SE94/01113

§ 371 Date: Jun. 19, 1996

§ 102(e) Date: Jun. 19, 1996

[87] PCT Pub. No.: WO95/18287

PCT Pub. Date: Jul. 6, 1995

[30] Foreign Application Priority Data

Dec. 29, 1993 [SE] Sweden ..... 9304322

[51] Int. Cl.[6] ..... E21B 7/06

[52] U.S. Cl. ..... 175/230; 175/76

[58] Field of Search ..... 175/230, 61, 76, 175/81, 82

[56] References Cited

U.S. PATENT DOCUMENTS

| | | | |
|---|---|---|---|
| 3,180,436 | 4/1965 | Kellner et al. | 175/230 X |
| 3,974,886 | 8/1976 | Blake, Jr. | 175/76 |
| 5,186,264 | 2/1993 | du Chaffaut | 175/230 |

FOREIGN PATENT DOCUMENTS

| | | |
|---|---|---|
| 2 920 049 | 2/1981 | Germany . |
| 444 027 | 3/1986 | Sweden . |
| WO 86/06784 | 11/1986 | WIPO . |
| WO 90/04082 | 4/1990 | WIPO . |
| WO 93/18273 | 9/1993 | WIPO . |

*Primary Examiner*—William P. Neuder

*Attorney, Agent, or Firm*—Young & Thompson

[57] ABSTRACT

A rock drill guide tool comprises a sleeve arrangement (8) placed around a tubular drill tube (9) which rotates during a drilling operation and through which drilling liquid is supplied under pressure during drilling intervals. The sleeve arrangement includes a plurality of support units (15, 16) which can be projected out into contact with the wall of a drill hole and which are placed circularly in the sleeve arrangement. The support units (15, 16) are placed in at least two ring sections of the sleeve arrangement and are provided with elements (19, 20) which project out against the wall of a drill hole. These elements engage the rock so as to cut grooves into the wall of a drill hole as the drill is moved down during a drilling operation. The outwardly projecting elements of all shoulder ring sections are placed mutually sequentially in an axial direction along straight lines, so that the outwardly projecting elements that are located behind the foremost elements in each line of elements as seen in the drilling direction will move in grooves cut in the rock by the foremost elements as the drill moves downward.

7 Claims, 4 Drawing Sheets

CONTROL DEVICE FOR DRILLING A BORE HOLE

BACKGROUND OF THE INVENTION

When drilling holes with the aid of a diamond drill for instance, the requirement of enabling the drill to be guided in a given specific direction has progressively increased. A diamond drill hole can be relatively long, more than 500 m in depth. It is difficult to know the precise location of the drill and what is happening. The problem resides in dosing the hole.

It is desirable that drilling can continue in one single stage until the lowermost drill tube, i.e. the tube to which the diamond drill is attached, is filled with a core of drill cuttings and must therefore be lifted from the hole and emptied. With earlier known drill arrangements it has been necessary to perform such drilling operations in several stages, while moving stepwise a so-called drill hole packer which is seated around the lower part of the drill tube and which functions as a guide means. One such arrangement is described in WO90/00666. The drill hole itself is used as a locking means in this case. The drill hole packer is clamped against the wall of the drill hole with the aid of the overpressure that is generated by the drilling liquid during each drilling interval. The drill is only able to penetrate through a relatively short distance, i.e. about 15 cm, before it is necessary to interrupt the drilling interval, wherewith the pressure is reduced so as to loosen the tension on the packer and therewith enable the central element to be moved downwards, whereafter a further drilling interval can be carried out, and so on. Thus, it is necessary to perform a plurality of such drilling intervals before the drill core is filled and must be taken up and emptied.

A drill pipe having a self-centering stabilizer is described in SE-8005248-3. The stabilizer includes a cylindrical sleeve which is provided with a ring of pads which project out against the wall of the drill hole so as to prevent the sleeve from rotating. The pads have a rounded outer surface so as to adapt to the curvature of the hole, and have a soft construction so as to prevent the loss of torque as a result of the braking action generated by the pads. The pads also extend along the full length of the stabilizer. Two stabilizers can be used however. The problem with these stabilizers is that they cannot be held stable in the hole because of the roundness. Although the pads may be provided with cemented carbide or diamond studs, these studs do not project outwards and are provided only to protect the pads themselves from wear.

OBJECTS OF THE INVENTION

One object of the invention is to provide a guide arrangement which will enable drilling to be effected continuously with the drill aligned in the drill hole, with the hole in the rock forming an arrangement guide sleeve, until the drill core is filled and must be taken up. Such a drill core may have a length in excess of 3 m. It must be possible to move the sleeve axially and to prevent the sleeve from rotating and hold the sleeve in line with the drill hole.

Another object of the invention is to provide a guide arrangement which will enable the drill core to be taken up and emptied without needing to take up the tool, i.e. the guide arrangement. This avoids the necessity of performing a new aligning operation when drilling is continued.

The aforesaid main objects of the invention are achieved with a guide arrangement having the characteristic features set forth in claim 1. Further solutions to the objects of the invention and further characteristics thereof are set forth in the remaining claims.

SUMMARY OF THE INVENTION

According to the present invention the guide sleeve uses the drill hole itself as a guide cylinder. The guide sleeve functions as a combined guiding and holding device.

BRIEF DESCRIPTION OF THE DRAWINGS

The invention will now be described in more detail with reference to the accompanying drawings, in which.

DESCRIPTION OF THE PREFERRED EMBODIMENTS

Figure 1:
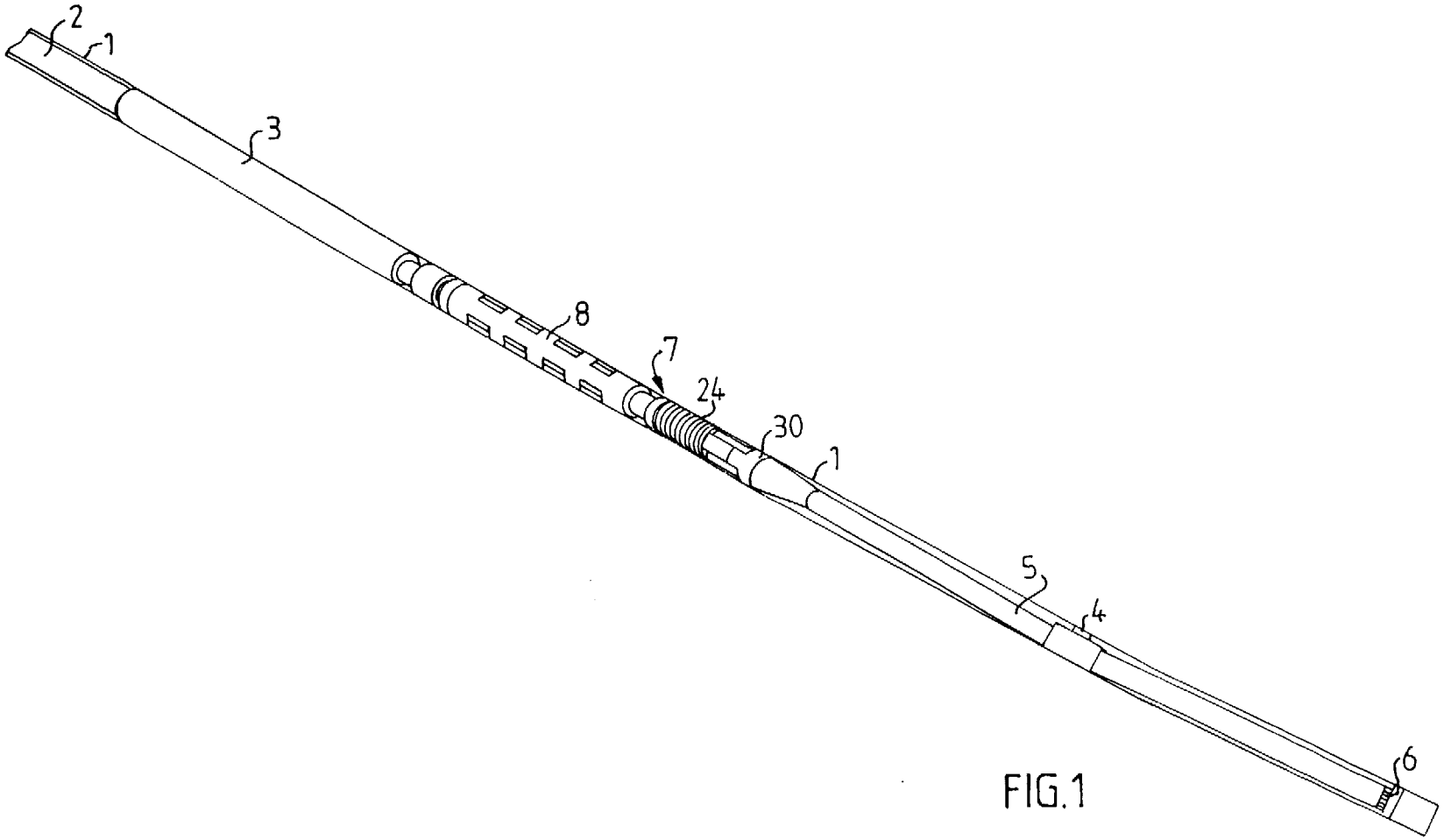
FIG. 1 is an overview of the lower end of a diamond drill tube with associated guide arrangement.

FIG. 1 illustrates a drill tube 2 located in a drill hole 1, extending from ground level. Seated in the end of the drill tube 2 is first a guide instrument 3 which detects the rotational position of an outer tube 5 placed further down in the drill hole and having a centrally positioned eccentric 4 which forces the outer tube 5 out towards the wall of the drill hole, therewith achieving a directional deviation which results in a change in direction of that part of the outer tube 5 in whose outer end a drill bit 6 is fitted. If no change in direction is required, the eccentric need not be fitted. The entire piece of equipment is inserted into the drill hole while fixed with a shear pin (not shown), in the event of needing to change the direction of the drill hole for some reason or another. The eccentric 4 has been exaggerated with regard to size in the Figure. Neither the guide instrument 3 nor the eccentric 4 form any part of the invention itself and will not therefore be described in more detail. A suitable embodiment of the guide instrument 3 for bringing the eccentric 4 to a correct rotational position in the drill hole prior to commencing drilling is described in Swedish Patent Specification 8503553-3.

Figure 2:
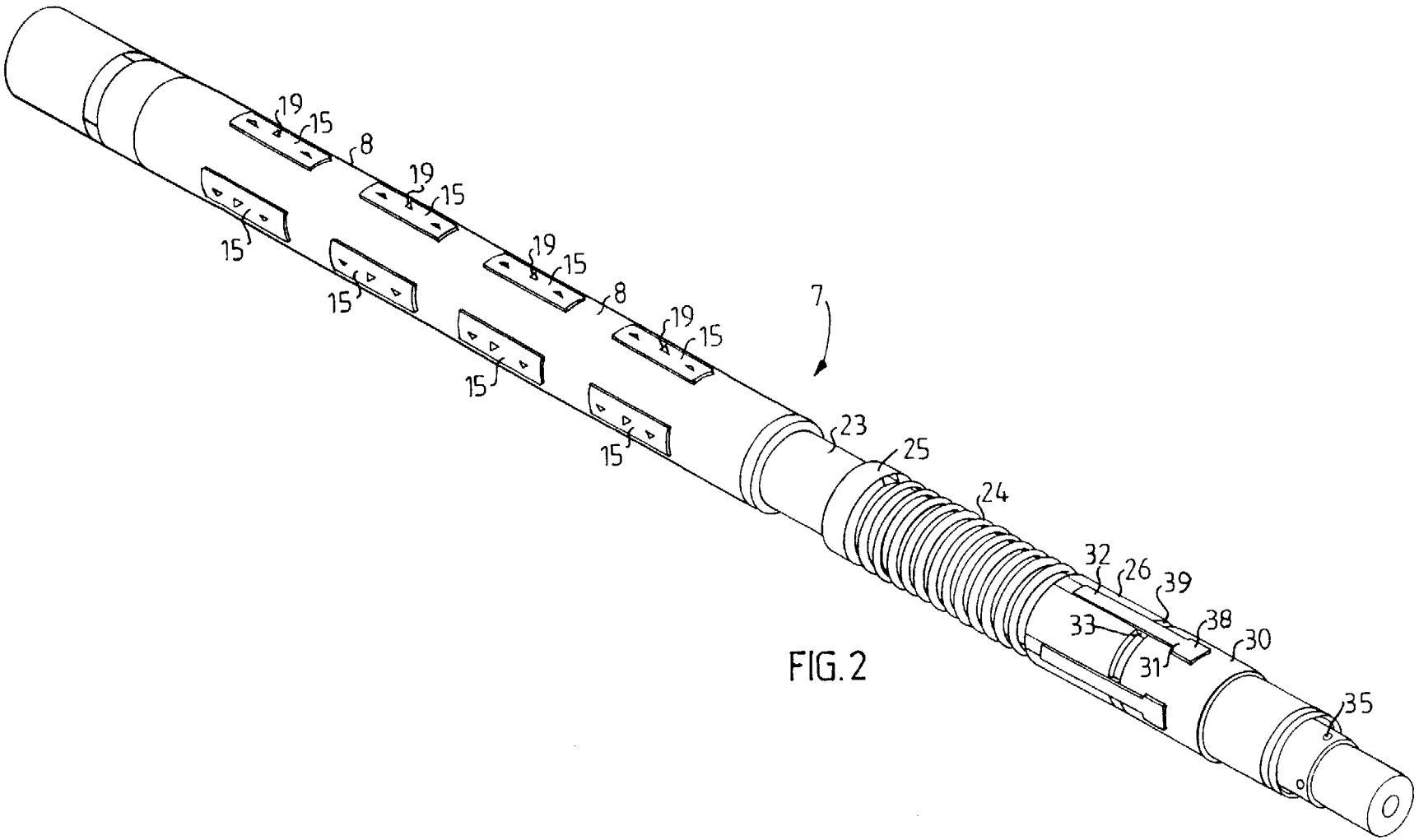
FIG. 2 is a perspective view of one embodiment of an inventive guide arrangement, in much larger scale than FIG. 1.
Figure 3:
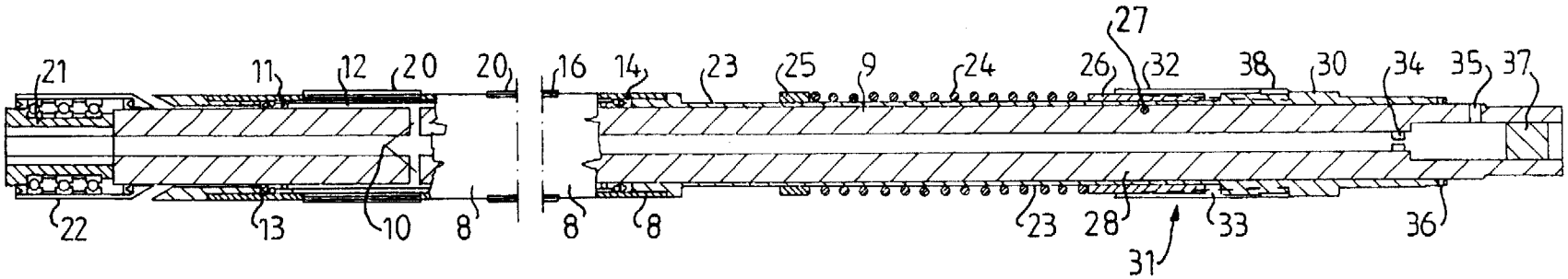
FIG. 3 is a longitudinal section view of the guide arrangement shown in FIG. 2, this arrangement having a different form of shoulders with outwardly projecting elements.
Figure 4:
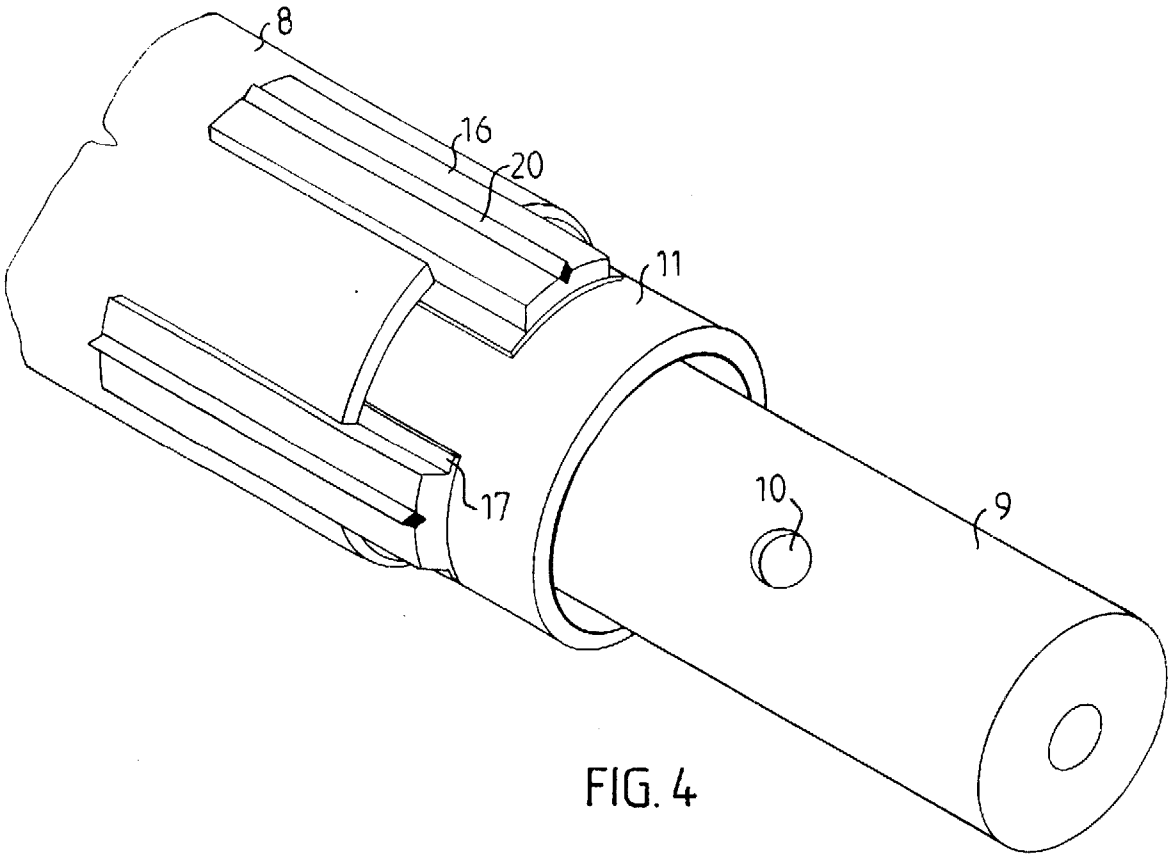
FIG. 4 is a perspective part-view, partially cut away, of an inventive guide sleeve having said different form of shoulders with outwardly projecting elements shown in FIG. 3.

FIGS. 2, 3 and 4 show two embodiments of the guide arrangements, these embodiments coinciding with one another with the exception of the particular design of support units 15 in FIG. 2 and 16 in FIG. 3 and 4. Consequently, corresponding parts have been identified with the same reference signs in all figures and the figures are also described in one context with the particular differences being specially illustrated.

A guide arrangement 7 is required to prevent the outer tube 5 from rotating while the inner drill tube rotates. It is also necessary for the drilling equipment to flex continuously and move conformingly down along the hole, when it has been necessary to curve or bend the hole with the aid of direction changing equipment. The guide arrangement 7 functions as a support for the rotating drill tube while drilling is in progress, which takes place at a speed of about 1000 to 1500 rpm. The guide arrangement 7 shall be prevented from rotating during the drilling operation.

In accordance with the invention, the guide arrangement 7 has been placed below the guide instrument 3 in the drill hole, i.e. between the guide instrument 3 and the outer tube 5 that functions as a deviation part.

According to the invention, the guide arrangement shall be able to follow the drill tube downwards during a drilling operation, until the drill tube in the outer tube 5 is completely filled with drill core, so that the tube must be taken up and emptied. In this regard, an advantage is gained when the guide arrangement is left in position in the drill hole. An embodiment for achieving this will be described in more detail below. That part of the drill tube which runs in the outer tube 5 often has a length of about 3 m or more.

As shown in FIGS. 2, 3 and 4, the upper end of the guide arrangement 7 carries a guide sleeve 8 which is firmly held hydraulically against the wall of the drill hole with the aid of friction. The drill tube is pressed downwards with a relatively large force during a drilling operation.

The guide sleeve 8 is provided with support units 15 in the FIG. 2 embodiment, and with support units 16 in the embodiment illustrated in FIGS. 3 and 4, and is intended to be held against the drill hole with a frictional force which is sufficiently low to be overcome in an axial direction as the drill tube is pressed downwards during a drilling operation but sufficiently high to prevent the sleeve from being rotated by the drill tube as said tube rotates.

The drill bit 6 must be supplied with drilling liquid, such as water at a water pressure of about 40 bars. The drilling liquid is delivered from ground level through the whole of the drill tube centrally thereof. In that part-section 9 of the drill tube located in the guide sleeve 8 there is provided at least one transverse hole 10 which extends from the hollow center of the drill tube to its outer surface. The part-section 9 is embraced by a stocking 11 made of an elastic, impervious material, such as rubber. A space 12 between the stocking 11 and the sleeve 8 is sealed at both ends by means of respective seals 13 and 14.

According to the invention, the guide sleeve 8 is provided along the length of its wall with shoulder 15 in FIG. 2 and shoulders 16 in FIGS. 3 and 4, which function as support devices and are disposed in a ring around the sleeve. These support devices are movable in a radial direction, by virtue of being placed in adapted holes in the sleeve wall. The embodiment illustrated in FIGS. 1 and 2 includes four rings of shoulders, although this number may be more or fewer than four. Four rings have been found to function well in practice, however. The sleeve must have at least two rings of shoulders however. The shoulders 15 or 16, are normally let into the sleeve wall and are provided on their insides with a lock piece 17 which will ensure that the shoulders are held in position in the sleeve but which will enable the shoulders to be moved out so that a part of said shoulders will project out beyond the wall of the sleeve 8.

Each shoulder 15 or 16 is provided with means which engage the wall of the drill hole. In the case of the FIG. 2 embodiment this means has the form of an outwardly projecting spike or point 19, which may have a prismatic configuration and which is made from a hard and durable material. In the case of the FIG. 3 and 4 embodiment, said means has the form of an outwardly projecting edge 20. It is essential that the spikes or edges on all shoulders, which lie in line with one another in an axial direction, also lie in line with one another. In this way, only the spike or spikes or the edge on the distal shoulder will make actual engagement with the wall of the drill hole as the drill moves downwards. The spike or spikes or edges on the remaining shoulders will then run in existing grooves. Tests carried out on the invention have shown that the spikes or edges produce relatively deep, longitudinally extending grooves in the drill hole. The frictional force generated by the shoulders and the spikes in engagement with the hole is adapted to be so low as to be overcome by the axial pressure acting on the drill tubes but high enough to prevent the sleeve 8 from being rotated by rotation of the drill tube 9. The spikes or edges on all shoulders will act against this rotary movement. When using spikes as in the FIG. 2 embodiment, it may be advantageous not to place these spikes in the same circumferentially extending circle on shoulders in the same ring of shoulders.

Naturally, other measures for obtaining the desired frictional force between the sleeve and the drill hole are conceivable. For instance, several edges may be placed parallel with one another. Tests have shown that in practice the best embodiment is one in which a longitudinally extending and outwardly projecting edge 20 on each shoulder 16 extends practically along the full length of the shoulder, this embodiment being shown in an enlarged part-view of the sleeve and shoulders in FIG. 4. This edge 20 may be ground or sharpened when the drill and the sleeve are located above ground. The edges have a greater resistance to wear than the spikes 19 in FIG. 2. Furthermore, the edges provide greater security against the sleeve 8 rotating in the drill hole, since the edges exert a restraining force along the whole of their length by virtue of being seated in the longitudinally extending grooves preformed in the wall of the drill hole, these grooves being created by the edges themselves. Neither need the edges be completely sharp, but may be slightly rounded or have the form of a truncated triangle when seen in cross-section. Although the edges become rounded in operation, they have still been found to provide a good gripping and guiding function.

FIG. 4 also shows that the shoulders may be completely flat, whereby their longitudinally extending edges also project out against the wall of the drill hole and form counterpressure means against rotation of the sleeve. This is the type of shoulder with edge shown in FIG. 1.

The different types of outwardly projecting elements may be used in combination, for instance such that each shoulder in the lowermost ring of shoulders will have more prisms, e.g. diamond prisms, which are placed sequentially in line so as to cut a groove, and each shoulder in the subsequent rings of shoulders may be provided with elongated edges (not shown).

When drilling is to be commenced, the drilling liquid pressure is raised so as to press the shoulders 15 or the shoulders 16 respectively out against the wall of the drill hole, part of this liquid passing out through the hole 10 and pressing the stocking 11 outwards against the inner wall of the sleeve 8. The seals 13 and 14 (see FIG. 3) function to prevent liquid from squirting out axially upwards and downwards. The guide sleeve 8 is therewith held against the wall of the drill hole in alignment with the direction of said hole, but so that the guide sleeve 8 is able to move downwards along the hole during the drilling operation. It is also possible to press the shoulders 15 or the shoulders 16 out against the wall of the drill hole during a drilling operation with the aid of some suitable arrangement other than the aforedescribed stocking. The essential criterium with regard to the inventive concept is that the shoulders and their outwardly projecting elements are pressed outwards.

The drill tube part 21 that extends from the guide instrument 2 is provided with a firmly seated bearing 22 whose diameter is larger than the diameter of the tube part 21. The bearing 22 has a conical front edge and fits into a conical recess in the rear end of the guide sleeve 8 and is therewith able to push the guide sleeve forwards and in a downward direction during a drilling operation. This provides a significant advantage, since drilling can be continued in one single stage until the bottom most distal part of the drill tube rotating in the sleeve 5 is filled with drill core or chippings and must therefore be taken up and emptied.

With earlier known drill arrangements it has been necessary to perform a drilling operation in several stages with stepwise movement of an arrangement functioning as a guide sleeve. The guide sleeve of the inventive arrangement uses the drill hole itself as a guide cylinder. The grooves cut in the wall of a drill hole by the lowermost spikes or edges on the shoulders form a highly effective guide groove for bringing the sleeve 8 into straight alignment. Earlier known arrangements have used the drill hole as a locking means. An essential feature of the invention is that drilling can be effected continuously during the actual drilling operation and also in several stages in which the core is emptied without needing to take up the outer part which includes the guide arrangement 7 and the outer tube 5, and that during a drilling operation the guide arrangement guides as a sleeve in the rock. The guide sleeve 8 functions as a combined means for guiding the drill tube and for holding the outer arrangement firmly in the drill hole when taking-up and emptying the inner drill tube.

The lower end of the guide sleeve 8 will preferably include an upper part of an outer tube part 23 which is fixed, e.g. screwed, to the guide sleeve 8 and through which the inner drill tube also runs. A compression spring 24 is fitted around the tube part 23. The upper end of the compression spring 24 is fixed to an annular ring clamp 25 attached to the tube 23. The lower end of the spring 24 is attached to an annular expander sleeve 26 which, at least when lowering the entire equipment down in a drill hole, can be fastened to the tube part 23 with the aid of some type of snap-lock means, for instance a ball lock means 27 between that part 28 of the drill tube around which the latching spring 24 and the expander sleeve 26 are seated and the expander sleeve 26. The snap-lock means can be opened as a result of moving the inner drill tube axially as the drill tube is pressed against the bottom of the drill hole in the desired drilling position. That part 28 of the drill tube placed within the tube 23 has a slightly smaller diameter than the remainder of the drill tube 9. Prior to inserting the whole of the drill tube and surrounding guide arrangement down into a drill hole, the compression spring 24 is tensioned so as to hold the expander sleeve 26 upwards against the spring 24.

The drill tube and its guide arrangement are twisted or rotated so that the eccentric force on the outer tube 5 is brought to its correct angular position to obtain the desired curvature of the drill hole, which is indicated by the guide instrument 3. Drilling can then commence. The ball lock will release as drill tube is pressed against the bottom of the drill hole, therewith enabling the compression spring to relax and the expander sleeve 26 to move downwards along the tube 23, around which the spring 24 is seated.

The tube 23 has a part 30 of larger diameter than the remainder of the tube 23, this part being placed at a short distance from the expander sleeve 26. The tube part 30 carries a plurality of latching and guiding tabs 31 placed in a ring around said part. Each tab 31 has a head 38 which is secured in the tube part 30, and also a resilient, elongated finger 32 which runs in a groove in the expander sleeve 26. The finger 32 has a ledge 33 which rests in a groove 34 between the expander sleeve 26 and the tube part 30. The expander sleeve 26 can be moved in its axial direction. When the tension in the compression spring 24 is released, the expander sleeve 26 is moved against the tube part 30 and the fingers 32 are lifted outwards by virtue of their ledges 33 being lifted up out of the groove 39. The fingers are therewith clamped against the wall of the drill hole. The purpose of the arrangement of the expander sleeve 26 and the tube part 30 is to retain the guide arrangement 7 in the drill hole when a drill core is lifted from the hole to be emptied. The end of the finger 32 of each tab 31 is clamped firmly against the wall of the drill hole and holds against upward movement. The water pressure is also nonexistent when the drill tube is taken up to be emptied, which enables the drill tube to be moved easily through the guide sleeve 8. On the other hand, the fingers 32 slide against the wall of the drill hole as the drill tube moves downwards in the drill hole.

The drill tube is spliced close to the lower end of the tube part 30. A constriction 34 is therewith placed in the center bore or hollow of the drill tube. This constriction 34 functions to increase the water pressure in the interior of the drill tube and is adapted so that liquid that flows out through the hole 10 in the part 9 of the drill tube in the sleeve 8 will have sufficient pressure to expand the stocking 11, which in turn then presses the guide tabs 15 or 16 respectively against the wall of the drill hole. The constriction 24 is exchangeable and can be adapted to different pressure conditions. The part of the drill tube located downstream of the constriction is provided on its upper side with a plurality of radial openings 35 through which drilling liquid is able to exit and flow down to the drill bit on the outside of the drill tube. A plug 37 is inserted into the part of the drill tube located downstream of the openings 35, to prevent drilling liquid from flowing into this part of the tube. The central hollow or cavity of the part of the drill tube located beneath the openings 35 is filled with drill core during a drilling operation. In order to prevent liquid from flowing upwards between the guide arrangement 7 and that part of the drill tube which rotates in said arrangement, rotating seals 36 are provided in the region of the constriction 34. The pressure of the drill hole liquid increases significantly when the drill core has reached to a level above the opening 35, this increasing pressure being detected at ground level and indicating that the drill core must be emptied.

It will be understood that many variations and modifications can be made within the scope of the invention as defined in the following claims.

We claim:

1. A rock drill guide tool, comprising:

a drill tube which rotates during a drilling operation, and which includes means for supplying a drilling liquid under pressure during drilling intervals;

a sleeve arrangement around said drill tube;

a plurality of support units positioned in a first ring section and at least a second ring section of said sleeve arrangement, and adapted to be projected outwards into contact with the walls of a drill hole, said support units constructed and arranged to be moved and held against a wall of the drill hole with a frictional force which is sufficiently lower to overcome downward pressure exerted by the drill tube in an axial direction during the drilling operation, but sufficiently high to latch the sleeve arrangement against rotation by the drill tube;

a plurality of outwardly projecting elements on said support units;

said elements at least on said first ring section having a size and shape for engravingly engaging the rock of the wall of the drill hole at least in the axial direction of the hole;

said outwardly projecting elements in said at least second ring section being positioned in the axial direction along straight lines in relation to said outwardly projecting elements in said first ring, and projected to rest in grooves cut by the elements in said first ring;

whereby upon downward movement of the drill during drilling only the element lowest in the drill hole in each line will cut a groove into the rock of the drill hole wall and every other element in each line will slide in said groove, and by resting in a longitudinal groove will prevent said sleeve arrangement from rotating when said drill tube is rotating.

2. The rock drill guide tool according to claim 1, wherein the outwardly projecting elements are prism-shaped spikes.

3. The rock drill guide tool according to claim 1, wherein the outwardly projecting elements have the form of edges elongated in the direction of the drill hole.

4. The rock drill guide tool according to claim 1, where in the support units are loosely mounted in the sleeve arrangement so as to enable said support units to be moved outwardly, and said support units being provided with support plates on their inner surfaces facing towards the inner surface of the drill tube, so as to prevent the support units from being pressed completely out of the sleeve arrangement.

5. The rock drill guide tool according to claim 1, further comprising a stocking made of elastic impervious material and placed around a tube part of the drill tube which is placed in the sleeve arrangement with the support units; and at least one radial hole provided in said tube part to allow drilling liquid to exit during a drilling interval and to expand the stocking into engagement with the inner surface of the sleeve arrangement so as to press the support unit outwards.

6. The rock drill guide tool according to claim 1, further comprising a compression spring placed around a part of the sleeve arrangement, said compression spring adapted to be tensioned by a tensioning ring at one end of the sleeve part and being lockable in a tensioned state by means of an expander sleeve provided with snap-lock means between the drill tube and the expander sleeve, wherein the snap-lock means is releasable when the drill tube has reached a position in which drilling commences.

7. The rock drill guide tool according to claim 1, wherein the sleeve arrangement includes a holding arrangement having latching units which are constructed and arranged to be moved out into contact with the wall of the drill hole and therewith hold the sleeve arrangement against upward movement immediately before the drill tube is lifted upwardly from the drill hole, whereby the sleeve arrangement remains in the drill hole when the drill is removed from said hole and emptied.

* * * * *